US010731435B2

(12) United States Patent
Vasques

(10) Patent No.: US 10,731,435 B2
(45) Date of Patent: Aug. 4, 2020

(54) ANNULAR BARRIER FOR SMALL DIAMETER WELLS

(71) Applicant: Welltec Oilfield Solutions AG, Zug (CH)

(72) Inventor: Ricardo Reves Vasques, Allerød (DK)

(73) Assignee: Welltec Oilfield Solutions AG, Zug (CH)

( * ) Notice: Subject to any disclaimer, the term of this patent is extended or adjusted under 35 U.S.C. 154(b) by 80 days.

(21) Appl. No.: 16/045,805

(22) Filed: Jul. 26, 2018

(65) Prior Publication Data

US 2019/0032441 A1 Jan. 31, 2019

(30) Foreign Application Priority Data

Jul. 27, 2017 (EP) ..... 17183604
Nov. 6, 2017 (EP) ..... 17200098

(51) Int. Cl.
*E21B 33/124* (2006.01)
*E21B 33/128* (2006.01)
(Continued)

(52) U.S. Cl.
CPC ..... *E21B 33/1208* (2013.01); *E21B 33/124* (2013.01); *E21B 33/127* (2013.01);
(Continued)

(58) Field of Classification Search
CPC ..... E21B 33/124; E21B 33/128; E21B 23/06; E21B 33/1216; E21B 33/1208
See application file for complete search history.

(56) References Cited

U.S. PATENT DOCUMENTS 3,385,367 A * 5/1968 Kollsman ..... E21B 33/1208 166/191
4,482,086 A * 11/1984 Wagner ..... E21B 33/1208 166/118
(Continued)

FOREIGN PATENT DOCUMENTS

EP 1 624 152 2/2006
EP 2 206 879 7/2010
EP 2 789 792 10/2014

OTHER PUBLICATIONS

Extended Search Report for EP17200098, dated Apr. 18, 2018, 7 pages.

*Primary Examiner* — Cathleen R Hutchins
(74) *Attorney, Agent, or Firm* — Nixon & Vanderhye P.C.

(57) ABSTRACT

The present invention relates to an annular barrier for being mounted as part of a well tubular metal structure for providing zonal isolation in a small diameter borehole downhole for isolating a first zone from a second zone, comprising an expandable metal sleeve having a first end and a second end and an outer face facing the borehole, a first end part having a first end connected to the first end of the expandable metal sleeve and a second end for being mounted as part of the well tubular structure, a second end part having a first end connected to the second end of the expandable metal sleeve and a second end for being mounted as part of the well tubular structure, wherein the first end of the first end part is connected end to end to the first end of the expandable metal sleeve, and the first end of the second end part is connected end to end to the second end of the expandable metal sleeve, and wherein the second ends of the end parts are provided with male or female thread connections for being mounted to corresponding male or female thread connections of the well tubular metal structure. The present invention also relates to a well tubular
(Continued)

Figure 1:
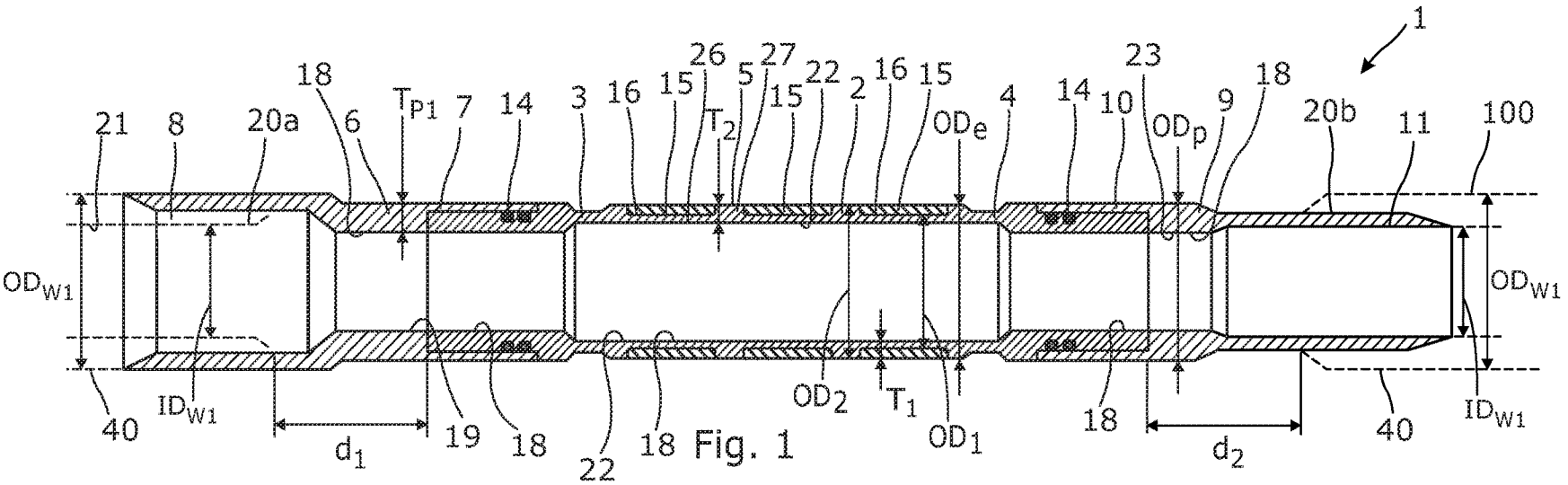

metal structure having a plurality of tubular sections and at least one annular barrier according to the present invention, and to a completion method of preparing an annular barrier according to the present invention.

20 Claims, 3 Drawing Sheets

(51) Int. Cl.
*E21B 23/06* (2006.01)
*E21B 33/12* (2006.01)
*E21B 33/127* (2006.01)

(52) U.S. Cl.
CPC ..... *E21B 33/128* (2013.01); *E21B 33/1212* (2013.01); *E21B 33/1277* (2013.01)

(56) References Cited

U.S. PATENT DOCUMENTS

| | | | | |
|---|---|---|---|---|
| 4,892,144 | A * | 1/1990 | Coone | E21B 33/1277 166/122 |
| 2004/0123983 | A1* | 7/2004 | Cook | E21B 33/10 166/50 |
| 2010/0252278 | A1 | 10/2010 | Harris et al. | |
| 2017/0101846 | A1* | 4/2017 | Vasques | E21B 33/1216 |
| 2017/0218734 | A1 | 8/2017 | Kumar | |

* cited by examiner

ANNULAR BARRIER FOR SMALL DIAMETER WELLS

This application and claims priority to EP Patent Application No. 17183604.2 filed 27 Jul. 2017, and EP Patent Application No. 17200098.6 filed 6 Nov. 2017, the entire contents of each of which are hereby incorporated by reference.

The present invention relates to an annular barrier for being mounted as part of a well tubular metal structure for providing zonal isolation in a small diameter borehole downhole for isolating a first zone from a second zone. The present invention also relates to a well tubular metal structure having a plurality of tubular sections and at least one annular barrier according to the present invention, and to a completion method of preparing an annular barrier according to the present invention.

Annular barriers for providing a zone isolation, e.g. for isolating a hydrocarbon-containing zone from a water producing zone, is provided by arranging an isolating element, such as an expandable metal sleeve surrounding the base pipe, such as the casing or liner, and are expanded by liquid from within the base pipe. However, in small diameter wells there is no room between the inner wall of the borehole and the base pipe for such annular barrier solutions, because the inner diameter of the base pipe would be too small for an efficient production. In such small diameter wells other solutions, such as swellable material around the base pipe, are used to provide the annular barrier.

The swelling of the swellable material is dependent on fluid content and temperature in the well and, most importantly, the deployment time from entering the well and until arrival at the determined position. Sometimes during deployment, the casing or well tubular metal structure gets stuck or is just much more difficult to deploy, resulting in the deployment time being much longer than planned, and in these cases, the swelling may occur too early and the barrier is then set too early. In small diameter wells, the space between the base pipe and the borehole wall is very narrow in order to maximise the inner diameter of the base and thus the production volume. Thus, in such small diameter wells, the risk of the casing or well tubular metal structure getting stuck is even higher than in larger wells.

Thus, it is an object of the present invention to wholly or partly overcome the above disadvantages and drawbacks of the prior art. More specifically, it is an object to provide an improved annular barrier for small diameter wells which does not set too early, i.e. before the barrier is in the intended position in the borehole.

The above objects, together with numerous other objects, advantages and features, which will become evident from the below description, are accomplished by a solution in accordance with the present invention by an annular barrier for being mounted as part of a well tubular metal structure for providing zonal isolation in a small diameter borehole downhole for isolating a first zone from a second zone, comprising:

- an expandable metal sleeve having a first end and a second end and an outer face facing the borehole,
- a first end part having a first end connected to the first end of the expandable metal sleeve and a second end for being mounted as part of the well tubular structure, and
- a second end part having a first end connected to the second end of the expandable metal sleeve and a second end for being mounted as part of the well tubular structure, wherein the first end of the first end part is connected end to end to the first end of the expandable metal sleeve, and the first end of the second end part is connected end to end to the second end of the expandable metal sleeve, and wherein the second ends of the end parts are provided with male or female thread connections for being mounted to corresponding male or female thread connections of the well tubular metal structure.

The above objects, together with numerous other objects, advantages and features, which will become evident from the below description, are accomplished by a solution in accordance with the present invention by an annular barrier for being mounted as part of a well tubular metal structure for providing zonal isolation in a small diameter borehole downhole for isolating a first zone from a second zone, the annular barrier having an inner face and comprising:

- an expandable metal sleeve having a first end and a second end, an inner face and an outer face facing the borehole,
- a first end part having a first end connected to the first end of the expandable metal sleeve and a second end for being mounted as part of the well tubular structure, the first end part having an inner face and
- a second end part having a first end connected to the second end of the expandable metal sleeve and a second end for being mounted as part of the well tubular structure, the second end part having an inner face, wherein the first end of the first end part is connected end to end to the first end of the expandable metal sleeve, and the first end of the second end part is connected end to end to the second end of the expandable metal sleeve, the expandable metal sleeve and the first and second end parts are connected so that the inner face of the expandable metal sleeve and the inner faces of the first and second end parts constitute the inner face of the annular barrier, and wherein the second ends of the end parts are provided with male or female thread connections for being mounted to corresponding male or female thread connections of the well tubular metal structure.

By the first end of the first end part being connected "end to end" to the first end of the expandable metal sleeve, and the first end of the second end part being connected "end to end" to the second end of the expandable metal sleeve, is meant that the ends are abutting and welded together or connected by a threading or similar connection. The inner face of the expandable metal sleeve thereby forms part of the inner face of the annular barrier and when mounted to the well tubular metal structure forms part of the inner face of the well tubular metal structure. Thus, the expandable metal sleeve does not overlap a tubular section of the well tubular metal structure nor the end parts in its entire thickness or length.

By having end parts having internal or external threads, the annular barrier can be connected as part of any well tubular metal structure, and the well tubular metal structure can be made with a substantially smaller outer diameter and fit into small diameter wells than annular barriers with a base pipe and a surrounding sleeve. The expandable metal sleeve is tested for expansion up to a certain radial expansion and by having the interchangeable end parts; the tested and qualified expandable metal sleeve can fit a variety of different well tubular metal structure and can quickly be changed on the platform or rig with other end parts to fit the borehole.

Furthermore, the first end part, the second end part and the expandable metal sleeve may form one tubular section configured to be mounted as part of the well tubular metal structure.

Moreover, the first and second end parts and the expandable metal sleeve are mounted in succession with each other.

In addition, the annular barrier may be without any enclosed space.

Also, the expandable metal sleeve and the first and second end parts are connected so that the inner face of the expandable metal sleeve and the inner faces of the first and second end parts constitute the inner face of the annular barrier configured to be in contact with a production fluid conveyed by the well tubular metal structure.

Furthermore, the expandable metal sleeve may be arranged in a non-overlapping configuration with other sections of the annular barrier.

Also, the expandable metal sleeve may be arranged in a non-overlapping configuration with the end parts in an entire thickness and/or length of the expandable metal sleeve.

The second end of the first end part may be provided with a female thread connection, and the second end of the second end part may be provided with a male thread connection.

Moreover, the first and second end parts may be connected to the first and second ends of the expandable metal sleeve by means of a standard connection, such as a stub acme thread connection.

Also, sealing elements may be arranged on the outer face of the expandable metal sleeve.

Further, the expandable metal sleeve may have:

- a first section having a first outer diameter and a first thickness, and
- at least two circumferential projections having a thickness which is larger than a first thickness and having a second outer diameter which is larger than the first outer diameter, so that when expanding the expandable metal sleeve, the first section bulges more radially outwards than the first section, resulting in the expandable metal sleeve being strengthened.

In addition, the expandable metal sleeve may have an outer sleeve diameter in an unexpanded state, the unexpanded outer sleeve diameter being equal to or smaller than an outer diameter of the first and second end parts.

Additionally, the sealing elements may be arranged in grooves in the outer face of the expandable metal sleeve.

The expandable metal sleeve may be made of a material which is more pliant than the material of the first and second end parts.

In order to determine if the material of the expandable metal sleeve is more pliant and thus easier to elongate than the material of the first and second end parts, the test standard ASTM D1457 Elongation can be used.

The annular barrier as described above may further comprise a split ring-shaped retaining element, the split ring-shaped retaining element forming a back-up for the sealing element.

Furthermore, the split ring-shaped retaining element may have more than one winding, so that when the expandable tubular is expanded from the first outer diameter to the second outer diameter, the split ring-shaped retaining element partly unwinds.

Also, the split ring-shaped retaining element may be arranged in an abutting manner to the sealing element.

Moreover, the first and second end parts may be tubular and may have a maximum wall thickness which is larger than a maximum wall thickness of the expandable metal sleeve.

Further, the expandable metal sleeve may be welded to the first and second end parts.

In addition, the expandable metal sleeve may have a length, and no tubular may be arranged within the expandable metal sleeve along the entire length of the expandable metal sleeve.

Said expandable metal sleeves may be expanded by an internal fluid pressure in the well tubular metal structure.

At least one of the tubular sections between the expandable metal sleeves may comprise an inflow section, a sensor section or a gas lift valve.

The present invention also relates to a well tubular metal structure having a plurality of tubular sections and at least one annular barrier according to the present invention; wherein the first and second end parts and the expandable metal sleeve are mounted in succession with the plurality of tubular sections, so that the first end part and the second end part are arranged between the expandable metal sleeve and the tubular sections along an axial extension of the well tubular metal structure.

Also, the first part, the second end part and the expandable metal sleeve may be connected so that the inner face of the expandable metal sleeve and the inner faces of the first and second end parts constitute the inner face of the annular barrier configured to be in contact with a production fluid conveyed by the well tubular metal structure.

Moreover, the first part, the second end part and the expandable metal sleeve may be connected so that the inner face of the expandable metal sleeve and the inner faces of the first and second end parts constitute the inner face of the well tubular metal structure configured to be in contact with a production fluid conveyed by the well tubular metal structure.

In addition, the expandable metal sleeve is arranged in a non-overlapping configuration with any one of the tubular sections of the well tubular metal structure.

Further, the expandable metal sleeve is arranged in a non-overlapping configuration with any element in an entire thickness and/or length of the expandable metal sleeve.

Furthermore, the well tubular metal structure may have an inner face, and an inner face of the expandable metal sleeve may form part of the inner face of the well tubular metal structure.

Moreover, the well tubular metal structure has an inner face, and the expandable metal sleeve and the first and second end parts may be connected so that the inner face of the expandable metal sleeve and the inner faces of the first and second end parts constitute the inner face of the annular barrier and the inner face of the well tubular metal structure.

Also, a second annular barrier according to present invention may be mounted as part of the well tubular metal structure, and a plurality of tubular sections may be mounted between the annular barriers.

Moreover, the first end part may create a first distance between the expandable metal sleeve and one of the pluralities of tubular sections, and the second end part may create a second distance between the expandable metal sleeve and another one of the plurality of tubular sections.

In addition, the expandable metal sleeve may not overlap any of the plurality of tubular sections.

Further, the expandable metal sleeve may have an outer sleeve diameter in an unexpanded state, the unexpanded outer sleeve diameter being equal to or smaller than an outer diameter of the tubular sections forming the well tubular metal structure.

The well tubular metal structure may be a production casing or a velocity string.

The present invention also relates to a downhole system comprising the well tubular metal structure according to the present invention and an expansion tool for isolating a part of the well tubular metal structure opposite the expandable metal sleeve for pressurising that part in order to expand the expandable metal sleeve.

Furthermore, the present invention relates to a completion method of preparing an annular barrier according to the present invention before being mounted as part of the well tubular metal structure, said completion method comprising:

- providing the expandable metal sleeve,
- making a female thread in the first end part,
- making a male thread in the second end part, and
- mounting the first and second end part with the expandable metal sleeve.

Finally, the present invention relates to a completion method comprising:

- mounting an annular barrier according to the present invention as part of the well tubular metal structure,
- submerging the well tubular metal structure into the borehole,
- retracting the well tubular metal structure in the event that the well tubular metal structure cannot be submerged to a predetermined depth,
- dismounting the annular barrier and part of a plurality of tubular sections of the well tubular metal structure,
- replacing the first and second end parts with other first and second end parts having a smaller outer thread diameter,
- replacing the part of the plurality of tubular sections with other tubular sections having a smaller outer diameter,
- remounting the annular barrier having the other first and second end parts of a smaller outer thread diameter, and
- submerging the remounted well tubular metal structure.

Figure 2:
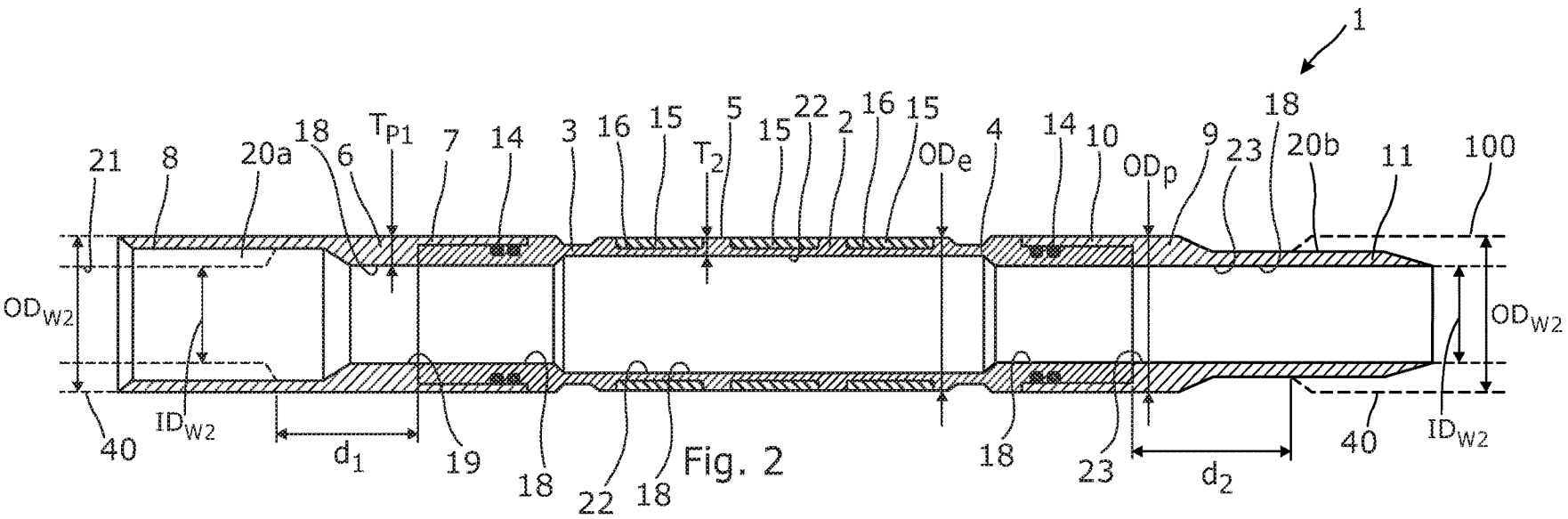
Figure 3:
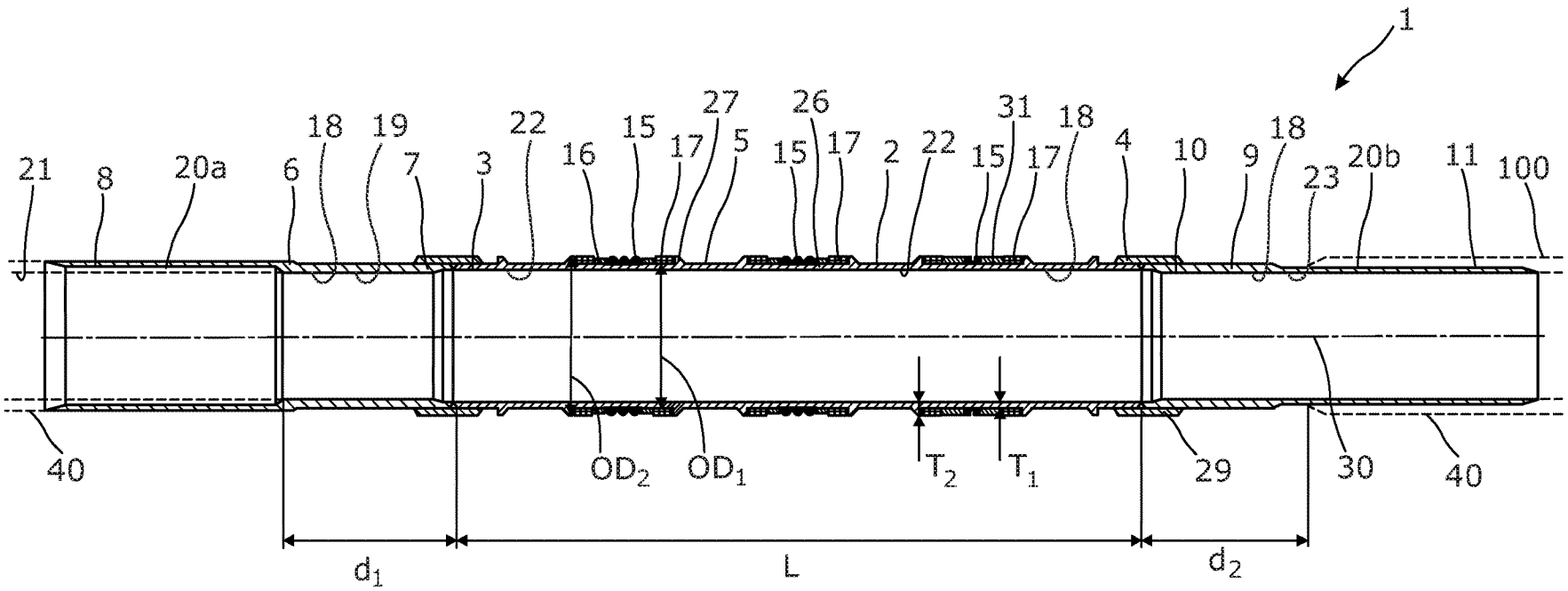
Figure 4:
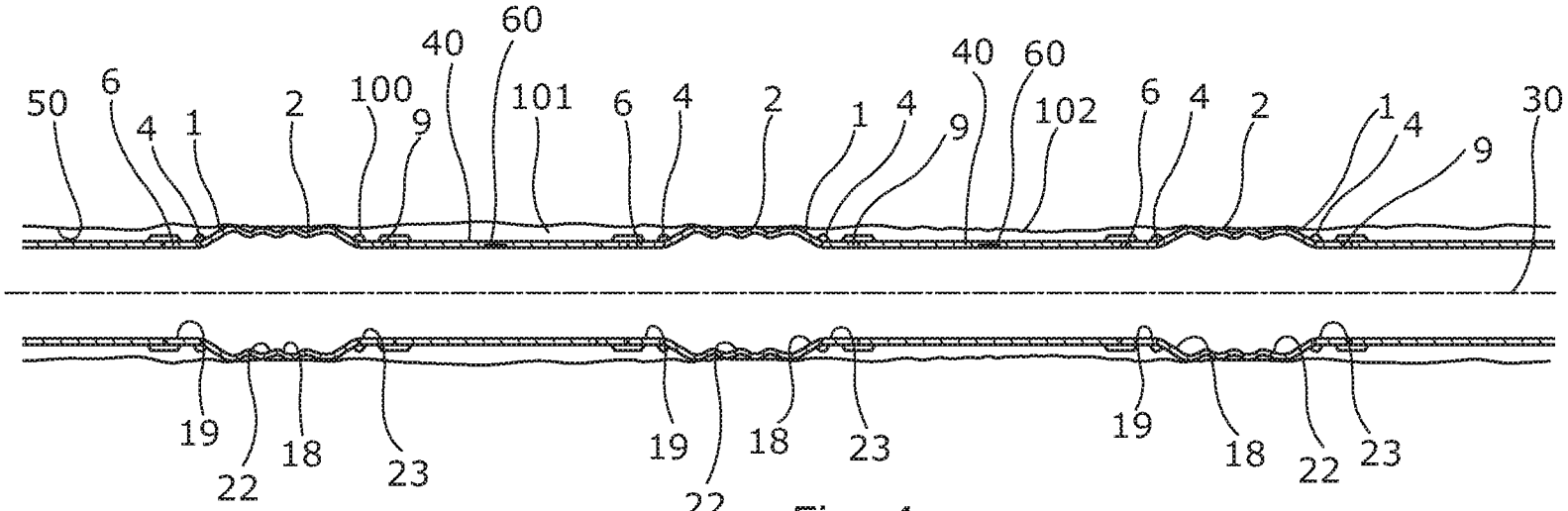

The invention and its many advantages will be described in more detail below with reference to the accompanying schematic drawings, which for the purpose of illustration show some non-limiting embodiments and in which:

FIG. 1 shows a cross-sectional view of an annular barrier for mounting as part of well tubular metal structure in a small diameter borehole, FIG. 2 shows a cross-sectional view of another annular barrier for mounting as part of well tubular metal structure in a small diameter borehole, FIG. 3 shows a cross-sectional view of yet another annular barrier for mounting as part of well tubular metal structure in a small diameter borehole, and FIG. 4 shows a well tubular metal structure having several annular barriers for isolating production zones from other zones.

All the figures are highly schematic and not necessarily to scale, and they show only those parts which are necessary in order to elucidate the invention, other parts being omitted or merely suggested.

FIG. 1 shows an annular barrier 1 for being mounted as part of a well tubular metal structure 100 for providing zonal isolation in a borehole downhole for isolating a first zone 101, e.g. producing oil or gas, from a second zone 102, e.g. producing water, as seen in FIG. 4. Tubular sections of the well tubular metal structure are illustrated by dotted lines in FIG. 1. The annular barrier 1 comprises an expandable metal sleeve 2 having a first end 3 and a second end 4 and an outer face 5 facing the borehole. The expandable metal sleeve 2 is shown in its unexpanded condition, and in order to provide zonal isolation, the expandable metal sleeve is expanded to a larger outer diameter by a hydraulic pressure from within to deform the expandable metal sleeve until the outer face presses towards the wall 50 (shown in FIG. 4) of the borehole. The annular barrier 1 further comprises a first end part 6 having a first end 7 connected to the first end of the expandable metal sleeve and a second end 8 for being mounted as part of the well tubular structure, and a second end part 9 having a first end 10 connected to the second end of the expandable metal sleeve and a second end 11 for being mounted as part of the well tubular structure. The first end 7 of the first end part 6 is connected "end to end" to the first end 3 of the expandable metal sleeve, so that part of the first end 7 overlaps part of the first end 3 and the ends of the parts connect end to end. Likewise, the first end 10 of the second end part 9 is connected "end to end" to the second end 4 of the expandable metal sleeve, so that they form one tubular pipe. Thus, there is no base pipe within the expandable metal sleeve along an entire length L (shown in FIG. 3) of the expandable metal sleeve and the annular barrier is therefore "base-less". The second ends 8, 11 of the end parts are provided with an external thread (male thread connection) 20*b* or an internal thread (female thread connection) 20*b* for being mounted to corresponding external or internal threads of the well tubular metal structure.

By providing such base-less annular barrier, the well tubular metal structure can be made with a substantially smaller outer diameter and fit into small diameter wells than annular barriers with a base pipe and a surrounding sleeve. The expandable metal sleeve has a first section 26 having a first outer diameter $OD_1$ and a first thickness $T_1$, and circumferential projections 27 having a thickness $T_2$ which is larger than the first thickness $T_1$ and having a second outer diameter $OD_2$ which is larger than the first outer diameter, so that when expanding the expandable metal sleeve, the first section bulges more radially outwards than the second section, resulting in the expandable metal sleeve 2 being strengthened in the expanded condition.

In small diameter wells, the expandable metal sleeve does not need to expand as much as in larger diameter wells/boreholes, and therefore it is possible for the expandable metal sleeve of the "base-less" annular barrier to maintain the barrier function without the base pipe.

Furthermore, the circumferential projections 27 increase the strength of the expanded expandable metal sleeve 2 when the expandable metal sleeve is not expanded more than required in small diameter wells/boreholes, so that the expandable metal sleeve can serve as both the base pipe and the barrier. The expandable metal sleeve therefore forms the well tubular metal structure.

The annular barrier has an inner face 18 which is provided by the expandable metal sleeve 2, the first end part 6 and the second end part 9 so that an inner face 22 of the expandable metal sleeve, an inner face 19 of the first end part 6 and an inner face 23 of the second end part 9 constitute the inner face of the annular barrier. Thus, the inner face of expandable metal sleeve thereby forms part of the inner face of the annular barrier and when mounted to the well tubular metal structure forms part of the inner face of the well tubular metal structure. Thus, the expandable metal sleeve does not overlap a tubular metal part when seen in cross-section along the longitudinal extension of the well tubular metal structure and thus does not overlap any tubular section of the well tubular metal structure nor the end parts in the entire thickness or length of the expandable metal sleeve. Therefore, the first end part, the second end part and the expandable metal sleeve form one tubular pipe configured to be mounted as one part of the well tubular metal structure between other two tubular sections of the well tubular metal structure. Thus, the expandable metal sleeve is arranged in a non-overlapping configuration with the end parts in an entire thickness and/or length of the expandable metal sleeve, and also in a non-overlapping configuration with other sections of the annular barrier. The first and second end parts and the expandable metal sleeve are mounted in succession of each other in succession with the other tubular sections mounted together to form the well tubular metal structure.

As can be seen in FIG. 4, the annular barrier 1 may be without any enclosed space and the expansion and setting of the annular barrier may occur without the use of ejecting pressured fluid into such annular space known from known annular barriers. The expandable metal sleeve 2 is expanded by pressurising the inside in the annular barrier, e.g. by plugging the well tubular metal structure further down and pressurise from the top or isolate a section of the well tubular metal structure having one or more annular barriers and pressurise just that section. The expandable metal sleeve and the first and second end parts are connected so that the inner face of the expandable metal sleeve and the inner faces of the first and second end parts constitute the inner face of the annular barrier configured to be in contact with a production fluid conveyed by the well tubular metal structure when production is initiated.

In FIG. 1, the second end 8 of the first end part 6 is provided with a female thread connection, i.e. an internal thread 20*b*, and the second end 11 of the second end part 9 is provided with a male thread connection, i.e. an external thread 20*a*. When submerging the annular barrier 1 as part of the well tubular metal structure 100, the female thread part, i.e. the female thread connection 20*a*, is most often the thread being closest to the top. The first and second end parts 6, 9 are connected to the first and second ends 3, 4 of the expandable metal sleeve 2 by means of a standard connection 14, such as a stub acme thread connection as shown. The first and second ends 3, 4 of the expandable metal sleeve 2 are provided with external threads matching internal threads of the first end part and the second end part 9, the internal and external threads forming the stub acme thread connections. Other standard connections within the oil industry can be used. Sealing elements 15 are arranged in grooves 16 on the outer face of the expandable metal sleeve 2 for increasing the sealing ability to the wall of the borehole when expanded downhole. The grooves 16 may be provided by the circumferential projections 27, and when expanding the expandable metal sleeve, the first section between the projections bulges more radially outwards than the projections, forcing the sealing element radially outwards. The expandable metal sleeve 2 has an outer sleeve diameter $Od_e$ in an unexpanded state, the unexpanded outer sleeve diameter being equal to or slightly smaller than an outer diameter $Od_P$ of the first and second end parts, so that the end parts protect the sealing elements while run in hole (RIH). The expandable metal sleeve of FIGS. 1 and 2 only has three grooves each having one sealing element. In another embodiment, the expandable metal sleeve has more than 3 grooves with sealing elements, e.g. 5-10 grooves.

In FIG. 1, the well tubular metal structure 100 has a first inner diameter $ID_{W1}$ and a first outer diameter $OD_{W1}$, and in FIG. 2 the well tubular metal structure 100 has a second outer diameter $OD_{W2}$ which is smaller than the first outer diameter. If during running the well tubular metal structure in the small diameter borehole, circulation of fluid is poor due to an unexpected narrowing of the borehole, the well tubular metal structure can then be retracted, and part of a plurality of tubular sections of the well tubular metal structure can be dismounted and replaced with tubular sections having a smaller outer diameter $OD_{W2}$, as shown in FIG. 2. This can easily be performed by replacing the first and second end parts 6, 9 of the annular barrier 1 with other first and second end parts of a smaller outer diameter at the thread connections, and mounting other tubular sections having a smaller outer diameter. Thus, by having disconnectable end parts 6, 9 of the annular barrier, the end parts 6, 9 can easily be replaced with other end parts matching smaller (or larger) outer diameter tubular sections, so that reducing the outer diameter of the well tubular metal structure at certain sections to increase circulation in a certain area is possible. When designing the well, the planner can not foresee every incident occurring during drilling and subsequent operations, and therefore the planner often plans to have more than one diameter casing/well tubular metal structure ready for completion but some components, such as annular barriers, are more expensive than just tubular pipe/sections and by the present invention, the annular barriers can fit tubular pipe sections having different diameter and thus the annular barrier can be mounted to fit the different casings the planner plans to have ready when completing just by changing the end parts.

As shown in FIG. 2, the first and second end parts 6, 9 are tubular and have a maximum wall thickness $T_1$ which is larger than a maximum wall thickness $T_2$ of the expandable metal sleeve 2. The expandable metal sleeve is made of a material which is more pliant than the material of the first and second end parts. In order to determine if the material of the expandable metal sleeve is more pliant and thus easier to elongate than the material of the first and second end parts, the test standard ASTM D1457 can be used.

In FIG. 3, the annular barrier 1 further comprises a split ring-shaped retaining element 17 forming a back-up for the sealing element 15. The split ring-shaped retaining element 17 has more than one winding, so that when the expandable tubular is expanded from the first outer diameter to the second outer diameter, the split ring-shaped retaining element partly unwinds. Thus, the split ring-shaped retaining element 17 may be arranged in an abutting manner to the sealing element, or an intermediate element 31 is arranged between the split ring-shaped retaining element 17 and the sealing element 15.

In FIGS. 1 and 2, the expandable metal sleeve 2 is connected to the end parts 6, 9 without any welded connections; however, in FIG. 3 the expandable metal sleeve 2 is welded to the first and second end parts 6, 9, and a connection ring 29 is arranged outside and overlapping the end 3, 4 of the expandable metal sleeve and the first end 7, 10 of the end part 6, 9 and is threadingly connected thereto.

As shown in FIG. 4, the well tubular metal structure 100 may have a plurality of tubular sections 40 arranged with one or more tubular sections 40 between two annular barriers 1, and the first and second end parts 6, 9 and the expandable metal sleeve 2 are mounted in succession with the plurality of tubular sections, so that the first end part 6 and the second end part 9 are arranged between the expandable metal sleeve 2 and the tubular sections along an axial extension 30 of the well tubular metal structure 100. The expandable metal sleeve 2, the end parts 6, 9 and the tubular sections 40 form one single walled pipe/tubular. Thus, an inner face 22 (shown in FIGS. 1-3) of the expandable metal sleeve 2 forms part of the inner face 21 (shown in FIGS. 1-3)

of the well tubular metal structure. A flow section 60 is furthermore arranged between two annular barriers in the first zone. The flow section provides primary flow into the well tubular metal structure, when the annular barriers have been expanded (as shown in FIG. 4), but may also be used for ejecting fluid into the annulus, e.g. for fracking the formation surrounding the well tubular metal structure 100.

As shown in FIGS. 1 and 2, the first end part creates a first distance $d_1$ between the expandable metal sleeve and one of the pluralities of tubular sections, and the second end part creates a second distance $d_2$ between the expandable metal sleeve and another one of the plurality of tubular sections. Thus, the expandable metal sleeve does not overlap any of the plurality of tubular sections.

The expandable metal sleeves are expanded by an internal fluid pressure in the well tubular metal structure. In order to provide an internal pressure, the entire well tubular metal structure may be pressurised from within, or an expansion tool for isolating a part of the well tubular metal structure opposite the expandable metal sleeve may be introduced in the well tubular metal structure for pressurising that part and expand the expandable metal sleeves one by one. The well tubular metal structure may be submerged by means of a drill pipe, and the annular barriers may be expanded by pressuring the drill pipe and the well tubular metal structure before disconnecting the drill pipe from the well tubular metal structure.

Even though not shown, at least one of the tubular sections between the annular barriers may comprise an inflow section for letting fluid into the well tubular metal structure also called the production casing. One of the tubular sections may also comprise a sensor section for measuring a condition downhole, e.g. for controlling and optimising the production. One of the tubular sections further up the well may also comprise a gas lift valve for introducing gas to reduce the hydrostatic pressure in the fluid column.

The well tubular metal structure may be a production casing installed more permanently in the borehole, or the well tubular metal structure may be a velocity string used for early production. In the event that the early production shows a successful result, the velocity string is then used as the production casing.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a well tubular metal structure or casing is meant any kind of pipe, tubing, tubular, liner, string etc. used downhole in relation to oil or natural gas production.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. An annular barrier for being mounted as part of a well tubular metal structure for providing zonal isolation in a small diameter borehole downhole for isolating a first zone from a second zone, the annular barrier having an inner face and comprising:

an expandable metal sleeve having a first end and a second end, an inner face and an outer face facing the borehole, the expandable metal sleeve being expandable by direct exposure to pressurized fluid between an unexpanded position radially spaced away from the borehole and an expanded position in contact with the borehole, a first end part having a first end connected to the first end of the expandable metal sleeve and a second end for being mounted as part of the well tubular structure, the first end part having an inner face and a second end part having a first end connected to the second end of the expandable metal sleeve and a second end for being mounted as part of the well tubular structure, the second end part having an inner face, wherein an outer diameter of the first and second end parts is equal to or greater than an outer diameter of the expandable metal sleeve in the unexpanded position, and the outer diameter of a metal portion of the expandable metal sleeve in the expanded position is greater than the outer diameter of the first and second parts and an outer diameter of the well tubular structure, wherein the first end of the first end part is connected end to end to the first end of the expandable metal sleeve, and the first end of the second end part is connected end to end to the second end of the expandable metal sleeve, the expandable metal sleeve and the first and second end parts are connected so that the inner face of the expandable metal sleeve and the inner faces of the first and second end parts constitute the inner face of the annular barrier, and wherein the second ends of the end parts are provided with male or female thread connections for being mounted to corresponding male or female thread connections of the well tubular metal structure.

2. An annular barrier according to claim 1, wherein the second end of the first end part is provided with a female thread connection and the second end of the second end part is provided with a male thread connection.

3. An annular barrier according to claim 1, wherein the first and second end parts are connected to the first and second ends of the expandable metal sleeve by means of a standard connection.

4. An annular barrier according to claim 1, wherein sealing elements are arranged on the outer face of the expandable metal sleeve.

5. An annular barrier according to claim 4, further comprising a split ring-shaped retaining element, the split ring-shaped retaining element forming a back-up for the sealing element.

6. An annular barrier according to claim 1, wherein the expandable metal sleeve has:

a first section having a first outer diameter and a first thickness, and at least two circumferential projections having a thickness which is larger than the first thickness and having a second outer diameter which is larger than the first outer diameter, so that when expanding the expandable metal sleeve, the first section bulges more radially outwards than the circumferential projections, resulting in the expandable metal sleeve being strengthened.

7. An annular barrier according to claim 1, wherein the expandable metal sleeve is made of a material which is more pliant than the material of the first and second end parts.

8. An annular barrier according to claim 1, wherein the first and second end parts are tubular and have a maximum wall thickness which is larger than a maximum wall thickness of the expandable metal sleeve.

9. An annular barrier according to claim 1, wherein the expandable metal sleeve has a length, and no tubular is arranged within the expandable metal sleeve along the entire length of the expandable metal sleeve.

10. A well tubular metal structure having a plurality of tubular sections and at least one annular barrier according to claim 1; wherein the first and second end parts and the expandable metal sleeve are mounted in succession with the plurality of tubular sections, so that the first end part and the second end part are arranged between the expandable metal sleeve and the tubular sections along an axial extension of the well tubular metal structure.

11. A well tubular metal structure according to claim 10, wherein the well tubular metal structure has an inner face, and the expandable metal sleeve and the first and second end parts are connected so that the inner face of the expandable metal sleeve and the inner faces of the first and second end parts constitute the inner face of the annular barrier and the inner face of the well tubular metal structure.

12. A well tubular metal structure according to claim 10, wherein a second annular barrier according to claim 1 is mounted as part of the well tubular metal structure and a plurality of tubular sections is mounted between the annular barriers.

13. A well tubular metal structure according to claim 10, wherein the first end part creates a first distance between the expandable metal sleeve and one of the plurality of tubular sections, and the second end part creates a second distance between the expandable metal sleeve and another one of the plurality of tubular sections.

14. A completion method of preparing an annular barrier according to claim 1 before being mounted as part of the well tubular metal structure, said completion method comprising:

providing the expandable metal sleeve, making the female thread connection in the first end part, making the male thread connection in the second end part, and mounting the first and second end part with the expandable metal sleeve.

15. A completion method comprising:

mounting the annular barrier according to claim 1 as part of the well tubular metal structure, submerging the well tubular metal structure into the borehole, retracting the well tubular metal structure in the event that the well tubular metal structure cannot be submerged to a predetermined depth, dismounting the annular barrier and part of a plurality of tubular sections of the well tubular metal structure, replacing the first and second end parts with other first and second end parts having a smaller outer thread diameter compared to the first and second end parts, replacing part of the plurality of tubular sections with other tubular sections having a smaller outer diameter, remounting the annular barrier having the other first and second end parts of a smaller outer thread diameter, and submerging the remounted well tubular metal structure.

16. An annular barrier according to claim 1, wherein the first end of each of the first part and the second part is detachably connected to the expandable metal sleeve.

17. An annular barrier according to claim 16, wherein each of the first and second end of the expandable metal sleeve includes a flat end surface, and the first end of each of the first and second parts include an interior flat surface axially displaced from a respective end of the first and second parts, wherein each said flat end surface abuts the respective interior flat surface of the first and second parts when the first and second parts are connected to the expandable metal sleeve.

18. An annular barrier according to claim 17, wherein each of the first and second parts includes an overlapping portion that overlaps the outer face of the first and second ends of the expandable metal sleeve, each said overlapping portion extending in an axial direction relative to the respective interior flat surface of the first and second parts.

19. An annular barrier according to claim 17, wherein the flat end surfaces and the interior flat surfaces extend substantially perpendicular to the axial direction.

20. An annular barrier according to claim 16, wherein the expandable metal sleeve comprises a material that is more pliant than a material of each of the first part and the second part, and each of the first part and the second part has a thickness that is greater than a thickness of the expandable metal sleeve.

* * * * *